US009850745B2

(12) United States Patent
Delgado et al.

(10) Patent No.: US 9,850,745 B2
(45) Date of Patent: Dec. 26, 2017

(54) HYDRAULIC CONNECTOR SYSTEM

(71) Applicant: Cameron International Corporation, Houston, TX (US)

(72) Inventors: Alexis Delgado, Maracaibo (VE); Ricardo Araujo, Maracaibo (VE); Jose Gutierrez, Maracaibo (VE)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/667,466

(22) Filed: Mar. 24, 2015

(65) Prior Publication Data

US 2016/0281473 A1 Sep. 29, 2016

(51) Int. Cl.
*E21B 43/013* (2006.01)
*E21B 33/038* (2006.01)
*E21B 23/04* (2006.01)

(52) U.S. Cl.
CPC ..... *E21B 43/013* (2013.01); *E21B 23/04* (2013.01); *E21B 33/038* (2013.01)

(58) Field of Classification Search
CPC ..... E21B 33/038
See application file for complete search history.

(56) References Cited

U.S. PATENT DOCUMENTS 3,071,188 A * 1/1963 Raulins ..... E21B 33/038 166/340
3,147,992 A 9/1964 Haeber et al.
3,228,715 A * 1/1966 Neilon ..... E21B 33/038 285/313
3,551,005 A * 12/1970 Andre ..... E21B 33/038 166/341
3,948,545 A * 4/1976 Bonds ..... E21B 17/085 285/39
3,986,729 A * 10/1976 Taylor ..... F16L 37/002 166/340
4,347,012 A * 8/1982 Glidden ..... B63B 21/50 114/230.2
4,372,584 A * 2/1983 Miller ..... F16L 1/26 285/18
4,374,595 A * 2/1983 Watkins ..... E21B 17/085 285/123.14
4,699,355 A * 10/1987 Tomlin ..... E21B 33/0355 251/62
5,433,274 A * 7/1995 Graff ..... E21B 33/038 166/368
5,494,110 A * 2/1996 Appleford ..... E21B 33/038 166/339

(Continued)

OTHER PUBLICATIONS

PCT International Search Report and Written Opinion; Application No. PCT/US2016/019194; dated Jun. 9, 2016; 12 pages.

*Primary Examiner* — Matthew R Buck
*Assistant Examiner* — Aaron L Lembo
(74) *Attorney, Agent, or Firm* — Fletcher Yoder, P.C.

(57) ABSTRACT

A system including a mineral extraction system, including a tubular with a fluid passage, a hydraulic connector system configured to couple to the tubular, the hydraulic connector system, including a hydraulic block configured to couple to one or more fluid lines, and a sleeve coupled to the hydraulic block and configured to move axially with respect to the hydraulic block to couple and uncouple the hydraulic connector system with the tubular.

29 Claims, 7 Drawing Sheets

(56) References Cited

U.S. PATENT DOCUMENTS

| | | | | |
|---|---|---|---|---|
| 5,775,427 | A * | 7/1998 | Skeels | E21B 33/038 166/344 |
| 6,386,291 | B1 * | 5/2002 | Short | E21B 33/0355 166/285 |
| 7,172,447 | B2 * | 2/2007 | Allensworth | F16L 1/10 439/271 |
| 7,216,699 | B2 * | 5/2007 | Nelson | E21B 23/02 166/338 |
| 8,474,537 | B2 | 7/2013 | Voss et al. | |
| 8,678,093 | B2 * | 3/2014 | Willoughby | E21B 33/035 166/338 |
| 2006/0079107 | A1 * | 4/2006 | Allensworth | F16L 1/10 439/271 |
| 2013/0299186 | A1 | 11/2013 | Nguyen et al. | |

* cited by examiner

HYDRAULIC CONNECTOR SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In order to extract hydrocarbons from the earth wells are drilled in surface and subsea locations. However, before production or extraction of hydrocarbons begins, exploratory wells are typically drilled to confirm the presence of hydrocarbons. In a subsea environment, an exploratory drill ship may be used to drill a well to check for hydrocarbons. If oil is discovered, the exploratory drill ship seals the casings in the well until production systems can be deployed to begin extraction. Once the production systems are in place, the productions systems couple to the casing in the well using a connector. The connector links the pipes in the well with a production string (e.g., pipes or casings coupled to a rig) that carries the hydrocarbons out of the well. In order to block hydrocarbons from escaping, the connector is secured and sealed between the casing in the well and the production string (e.g., pipes coupled to a rig).

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The embodiments discussed below include a hydraulic connector system that enables resource extraction from sub-sea locations by providing a connection between a production string and a well. More specifically, the hydraulic connector system is capable of coupling and sealing with a casing (e.g., tubular) in a wellhead. As will be explained in detail below, the hydraulic connector system includes a hydraulic block, a sleeve, a lock system, and one or more seals. In operation, the hydraulic block couples to and receives fluid from one or more fluid lines. The hydraulic connectors system uses the fluid flowing through the one or more fluid lines to perform various operations including coupling, uncoupling, and sealing with a casing. For example, the hydraulic block directs fluid into a actuation chamber to drive a sleeve axially and energize a lock system. The hydraulic block may also use fluid from one or more fluid lines to actuate seals and test seal integrity in the hydraulic connector system.

Figure 1:
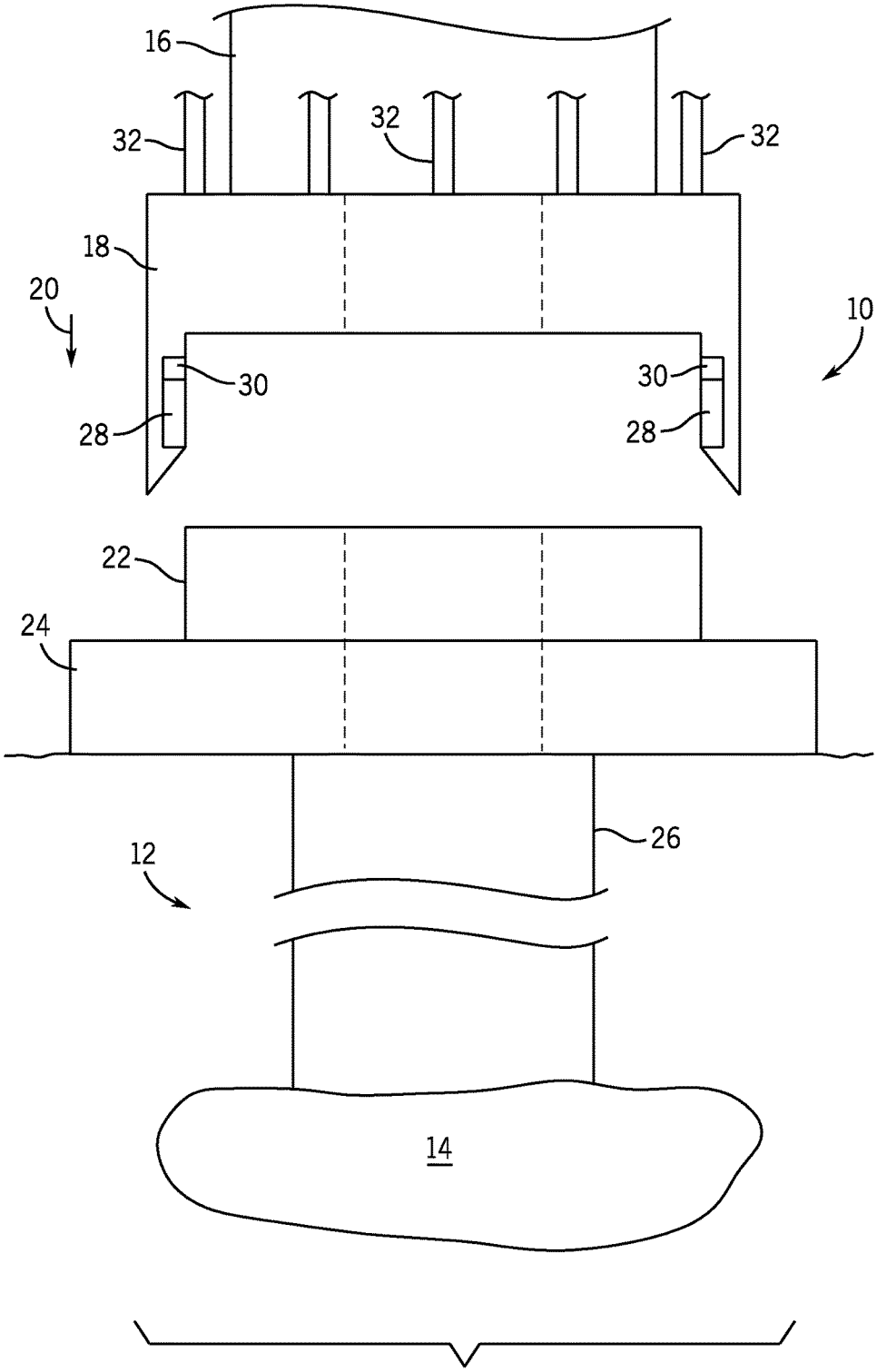
FIG. 1 is a block diagram of an embodiment of a mineral extraction system.

FIG. 1 is a block diagram that illustrates a mineral extraction system 10 (e.g., subsea hydrocarbon extraction system) that can extract various minerals and natural resources, including hydrocarbons (e.g., oil and/or natural gas) from a seabed. As explained above, during exploration a drillship may drill a well 12 enabling extraction of hydrocarbons from mineral deposit 14. After drilling the well 12, a production system (e.g., a rig) may be deployed to begin extraction of hydrocarbons (e.g., production). In order to couple the production system to the well 12, a production string 16 (e.g., pipes, casings) with a hydraulic connector 18 is lowered in axial direction 20 until the hydraulic connector 18 couples to a casing 22 in a wellhead hub 24. Once coupled, the hydraulic connector 18 forms a secure connection that enables extraction of hydrocarbons through the well-bore 26, while blocking hydrocarbons from escaping into the subsea environment. In order to couple to and seal with the casing 22, the hydraulic connector 18 includes a locking system 28 and seals 30 (e.g., annular seals). In operation, the hydraulic connector 18 uses hydraulic pressure in fluid lines 32 to control the locking system 28, energize one or more seals 30, and/or test seal integrity of one or more seals 30.

Figure 2:
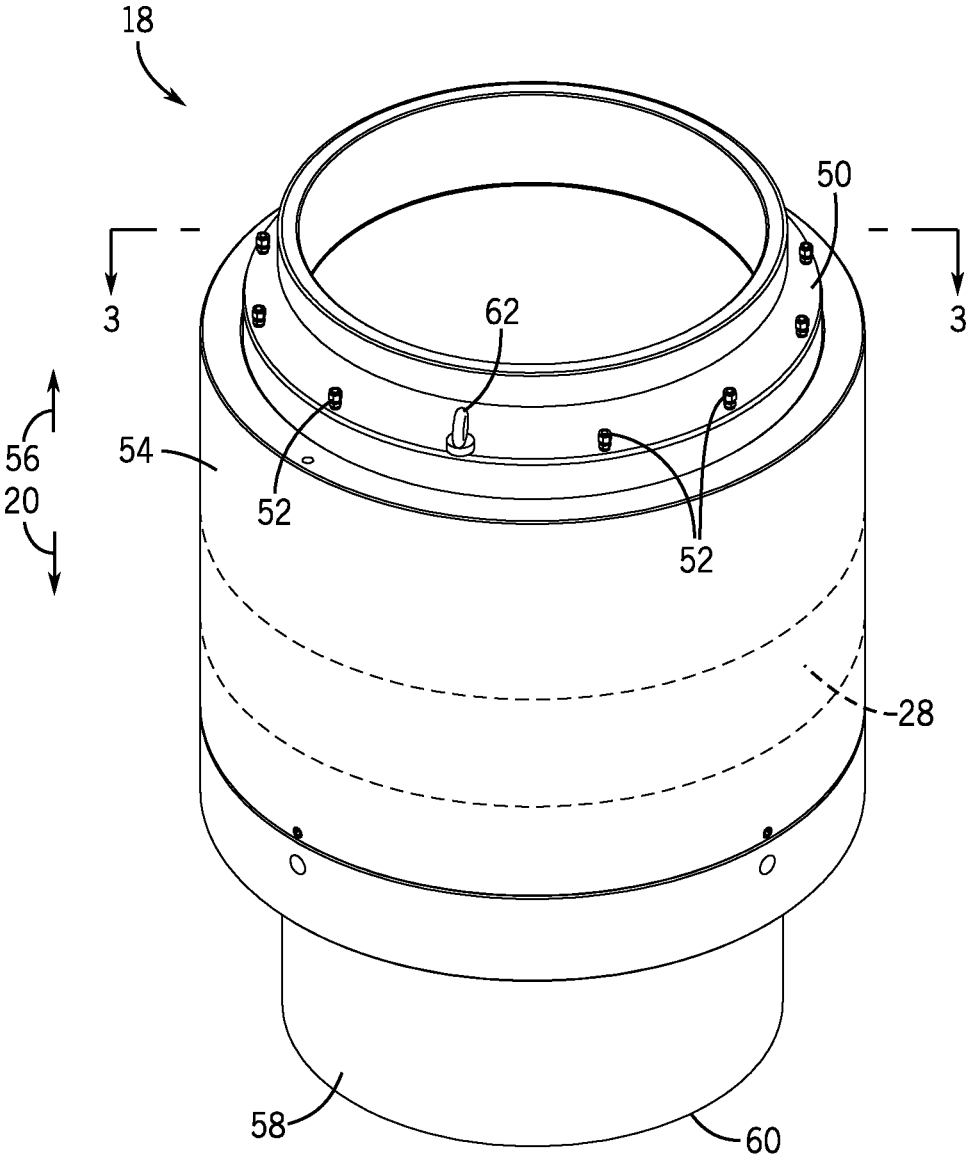
FIG. 2 is a perspective view of an embodiment of a hydraulic connector system.

FIG. 2 is a perspective view of an embodiment of a hydraulic connector 18. The hydraulic connector 18 includes a hydraulic block 50 (e.g., annular body) with a plurality of connectors 52 (e.g., hydraulic fluid ports). As will be explained in detail below, the connectors 52 receive fluid (e.g., hydraulic fluid), through the fluid lines 32 seen in FIG. 1 (e.g., control lines), enabling the hydraulic connector 18 to couple to and seal with a well 12. For example, surrounding the hydraulic block 50 is a sleeve 54 (e.g., annular sleeve). In operation, fluid enters between the hydraulic block 50 and the sleeve 54, which drives the sleeve 54 in axial direction 56 and energizes the locking mechanism 28. Moreover, in some embodiments, the hydraulic connector 18 includes a guide skirt 58 (e.g., annular skirt) that couples to the sleeve 54. The guide skirt 58 includes a flared end 60 (e.g., diverging and/or conical inner surface) that facilitates alignment with the casing 22 (seen in FIG. 1) as the hydraulic connector 18 is lowered into position. Finally, in some embodiments, one or more eyebolts 62 (e.g., 1, 2, 3, 4, 5) may couple to the hydraulic block 50 enabling wires or cables to lower the hydraulic connector 18 into position.

Figure 3:
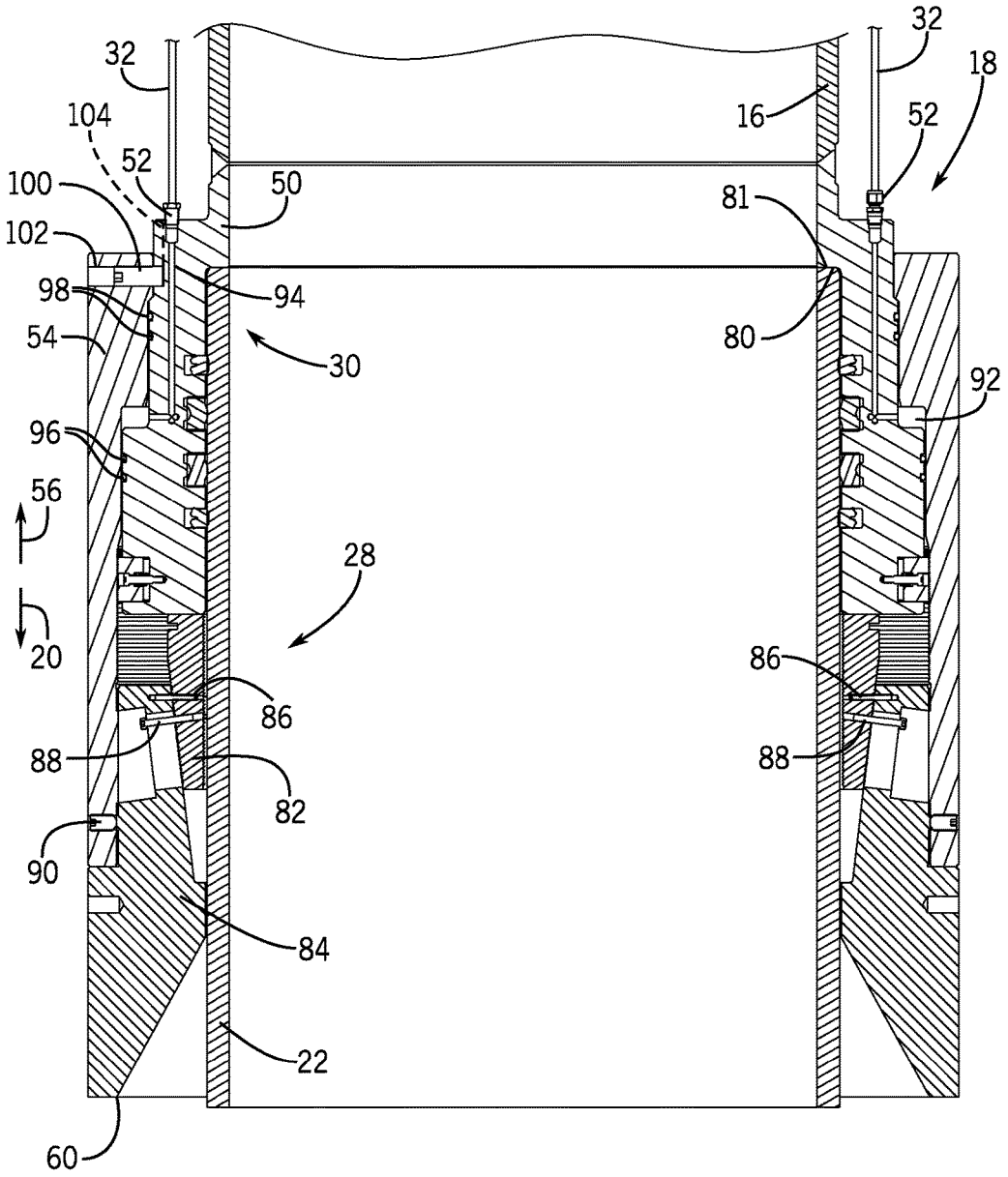
FIG. 3 is a cross-sectional view along line 3-3 of FIG. 2 of an embodiment of a hydraulic connector system in an unlocked position.

FIG. 3 is a cross-sectional view along line 3-3 of FIG. 2 of an embodiment of a hydraulic connector 18 in an unlocked position. As illustrated, the hydraulic block 50 is lowered in axial direction 20 until a ledge 80 (e.g., annular shoulder or axial abutment) of the hydraulic block 50 contacts a corresponding axial abutment 81 of the casing 22. In this position, the hydraulic connector 18 is ready to lock (e.g., couple) and seal with the casing 22 using the respective locking system 28 and one or more seals 30. The locking system 28 includes one or more lock segments 82 (e.g., 1, 2, 3, 4, 5, or more) that are spaced circumferentially about the casing 22 and an energizing ring 84. In some embodiments, the lock system 28 may in include a c-ring instead of the lock segments 82. The lock segments 82 couple to the energizing ring 84 with one or more shear pins 86 and connectors 88 (e.g., threaded fasteners, screws, bolts, pins, etc.). The energizing ring 84 in turn couples to the sleeve 54 with a connector 90 (e.g., threaded fasteners, screw, bolt, pins, etc.). As illustrated, the sleeve 54 circumferentially surrounds the hydraulic block 50 forming an actuation chamber 92 (e.g., annular chamber) that enables fluid (e.g., hydraulic fluid) to drive the sleeve 54 in axial direction 56. Thus, the sleeve 54 may also be described as a piston, piston sleeve, or hydraulically activated sleeve 54. As explained above, hydraulic fluid is pumped into the hydraulic block 50 through one or more fluid lines 32 (e.g., 1, 2, 3, 4, or more) and the respective connectors 52. The hydraulic fluid is then guided through one or more passages 94 (e.g., axial and radial passages) in the hydraulic block 50 to the actuation chamber 92. The actuation chamber 92 retains the hydraulic fluid using one or more seals 96 and 98 (e.g., circumferential or annular seals) between the hydraulic block 50 and the sleeve 54. As fluid enters the actuation chamber 92, the hydraulic pressure drives the sleeve 54 in axial direction 56. As illustrated, the sleeve 54 couples to the hydraulic block with one or more connectors 100 (e.g., threaded fasteners, screws, bolts, pins, etc.) that pass through one or more apertures 102 in the outer sleeve 54, before coupling to one or more axial slots 104 in the hydraulic block 50. Accordingly, as hydraulic fluid enters and exits the actuation chamber 92, the sleeve 54 is able to move axially in directions 20 and 56, as the connectors 100 move within the axial slots 104. Thus, the connectors 100 and axial slots 104 may represent an axial guide or anti-rotation guide. For example, each connector 100 may be a male anti-rotation feature or axial guide, while slot 104 may be a female anti-rotation feature or axial guide.

Figure 4:
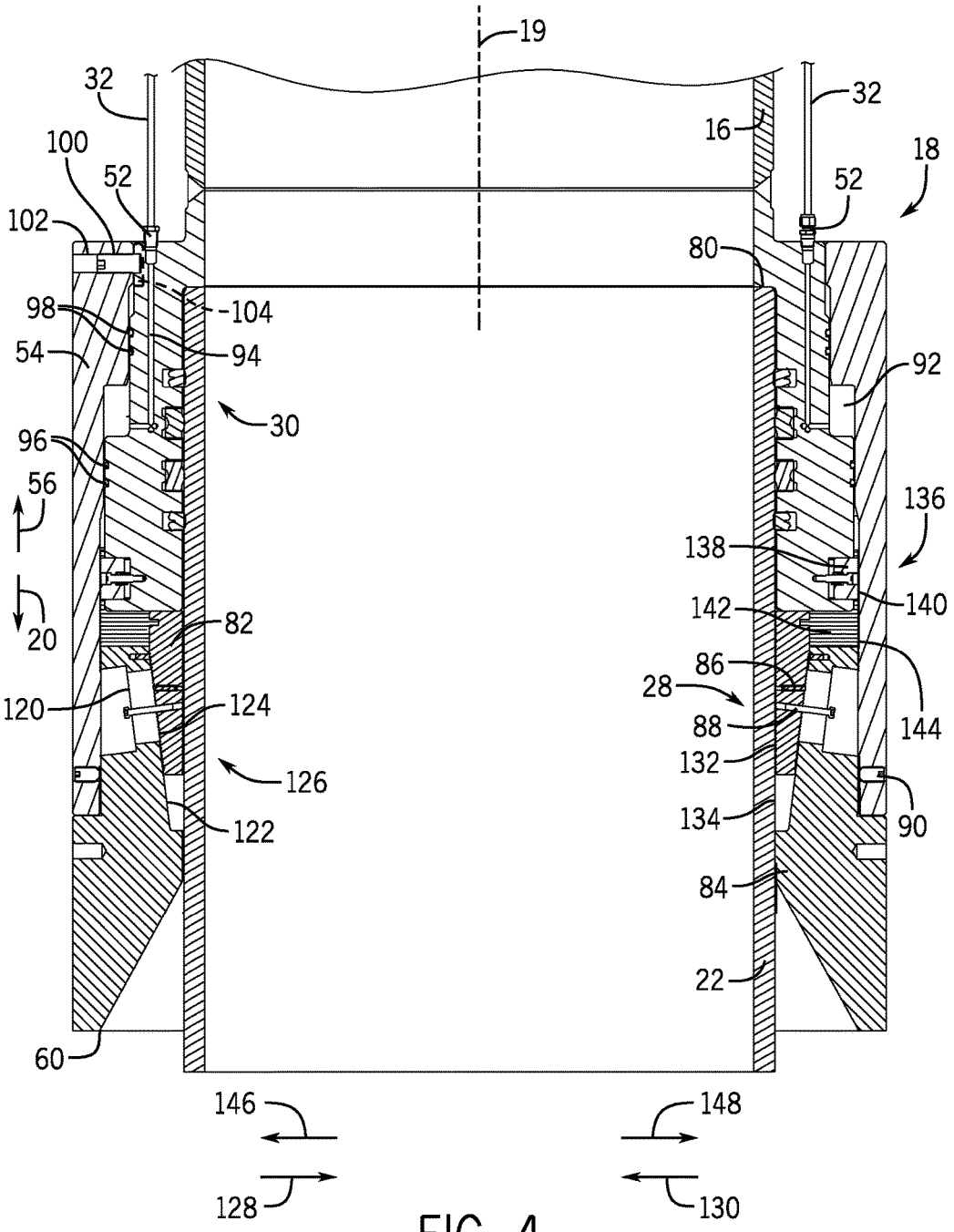
FIG. 4 is a cross-sectional view along line 3-3 of FIG. 2 of an embodiment of a hydraulic connector system in a locked position.

FIG. 4 is a cross-sectional view along line 3-3 of FIG. 2 of an embodiment of a hydraulic connector 18 in a locked position. As explained above, when hydraulic fluid is pumped into the actuation chamber 92, the pressure drives the sleeve 54 in axial direction 54. The axial movement of the sleeve 54 then pulls the energizing ring 84 in axial direction 56. As the energizing ring 84 moves in axial direction 56, the energizing ring 84 shears through the shear pin 86 enabling the connector 88 to move within the slot 120. As illustrated, the energizing ring 84 and lock segments 82 include respective angled surfaces 122 and 124 (e.g., acutely tapered or conical surfaces) that contact each other forming an angled interface 126. The angled surfaces 122 and 124 and angled interface 126 are acutely angled relative to a central axis 19 (e.g., acute angle of 1 to 75, 2 to 60, 3 to 50, 4 to 40, or 5 to 30 degrees). In operation, the angled interface 126 enables the energizing ring 84 to drive the lock segments 82 radially inward in radial directions 128 and 130, to couple the lock segments 82 to the casing 22. In other words, the energizing ring 84 compresses the lock segments 82 against the casing 22. In some embodiments, the lock segments 82 may include teeth or protrusions 132 that facilitate coupling between the lock segments 82 and the outer surface 134 of the casing 22. Once coupled, the hydraulic connector 18 may remove the hydraulic pressure from the fluid in the actuation chamber 92. In order to block the sleeve 54 from sliding again in axial direction 20, after removing the hydraulic pressure, the hydraulic connector 18 includes a lock ring system 136. As will be explained in detail below, the lock ring system 136 includes a lock ring 138 with protrusions 140 (e.g., teeth) that engage corresponding grooves 142 (e.g., annular grooves) on an interior surface 144 of the sleeve 54. The lock ring system 136 uses the protrusions 140 to selectively engage and disengage the grooves 142 on the sleeve 54. When the lock ring system 136 uses the protrusions 140 to engage the grooves 142, the lock ring system 136 blocks movement of the sleeve 54 in axial direction 20, which keeps the lock segments 82 coupled to the casing 22. In order to uncouple the hydraulic connector 18 from the casing 22, the lock ring system 136 may disengage the protrusions 140 from the grooves 142 enabling the sleeve 54 and energizing ring 84 to move in axial direction 20. As the energizing ring 84 moves in axial direction 20, the energizing ring 84 removes the radial force, in direction 128 and 130, to compress the lock segments 82 against the casing 22. Accordingly, the lock segments 82 may move in radial directions 146 and 148 enabling the hydraulic connector 18 to disconnect from the casing 22.

Figure 5:
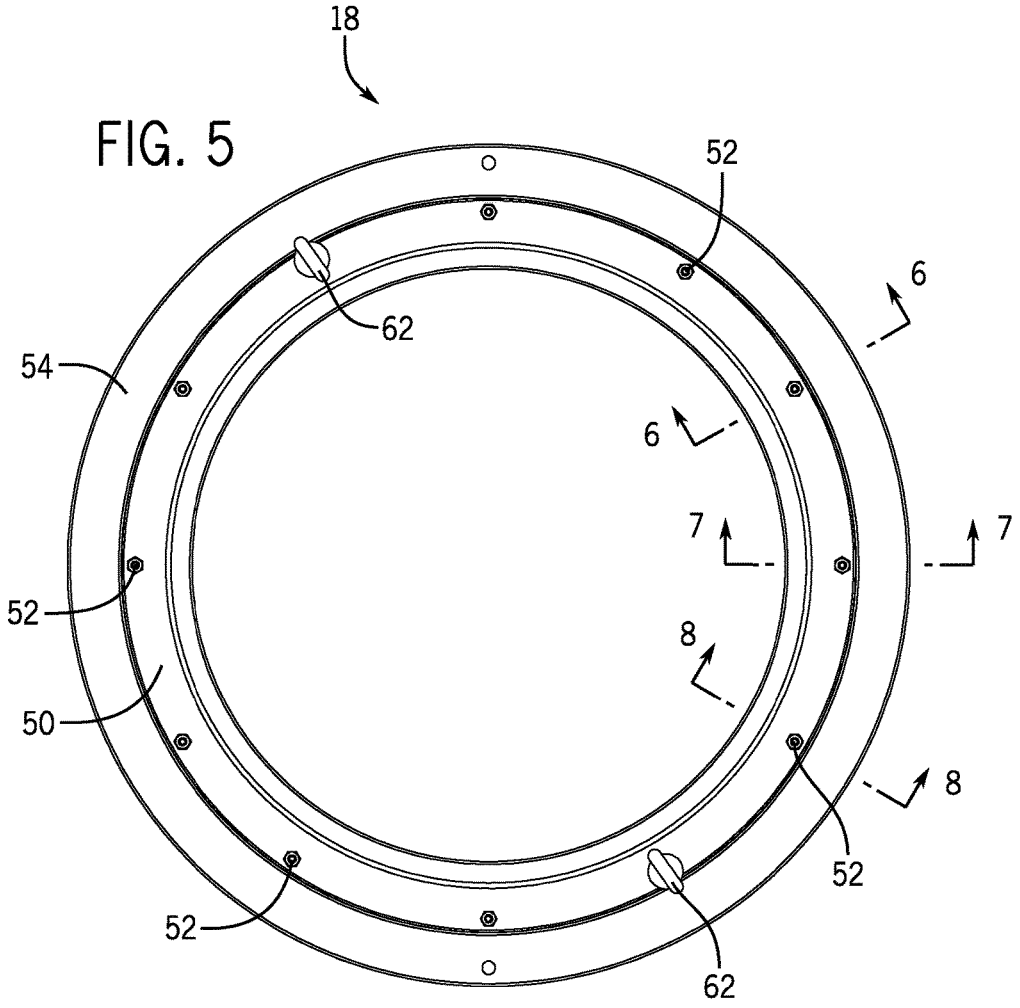
FIG. 5 is a top view of an embodiment of a hydraulic connector system.

FIG. 5 is a top view of an embodiment of a hydraulic connector 18. As illustrated, the sleeve 54 circumferentially surrounds the hydraulic block 50. As will be explained in detail below, the hydraulic block 50 include multiple hydraulic passages (e.g., passage 94) that enable fluid to actuate seals, test seals, drive the sleeve 54 in axial direction 56, and actuate the lock ring system 136 (e.g., disengage the lock ring system 136). These hydraulic passages in turn couple to a respective fluid or fluid line 32 via a connector 52 (seen in FIG. 1).

Figure 6:
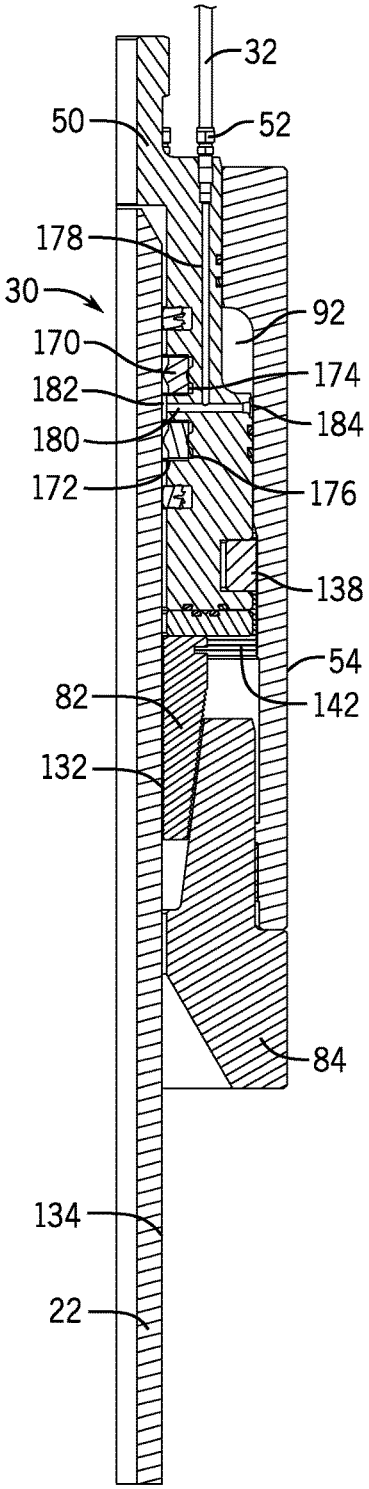
FIG. 6 is a cross-sectional view along line 6-6 of FIG. 2 of an embodiment of a hydraulic connector system in a locked position.

FIG. 6 is a cross-sectional view along line 6-6 of FIG. 2 of an embodiment of a hydraulic connector 18 in a locked position. Once the hydraulic connector 18 couples to the casing 22, the hydraulic connector 18 may test seals to detect whether the hydraulic connector 18 forms a proper seal with the casing 22. For example, the hydraulic connector 18 may include two seals 170 and 172 (e.g., circumferential seals) that rest within respective grooves 174 and 176 (e.g., circumferential or annular grooves) in the hydraulic block 50. The seals 170 and 172 are positioned at different axial positions within the hydraulic block 50 to sealingly engage the outer surface 134 of the casing 22. In order to test the whether the seals 170 and 172 are sealingly engaged with the casing 22, the hydraulic block 50 includes an axial fluid passage 178 that fluidly couples to a radial passage 180. In operation, fluid flows through the axial passage 178 and into the radial passage 180, which then directs the fluid toward a space 182 (e.g., annular space) between the seals 170 and 172, testing whether the seals 170 and 172 have formed a proper seal with the casing 22. For example, a seal test system may monitor whether the pressure of the fluid in the axial fluid passage 178 and radial passage 180 stays the same or changes over time (e.g., loses pressure) to determine whether the seals 170 and 172 have formed a proper seal. In some embodiments, the radial passage 180 may extend completely through the hydraulic block 50. Accordingly, some embodiments may include a plug 184 that blocks fluid flow, through the axial passage 178 and the radial passage 180, from entering the actuation chamber 92.

Figure 7:
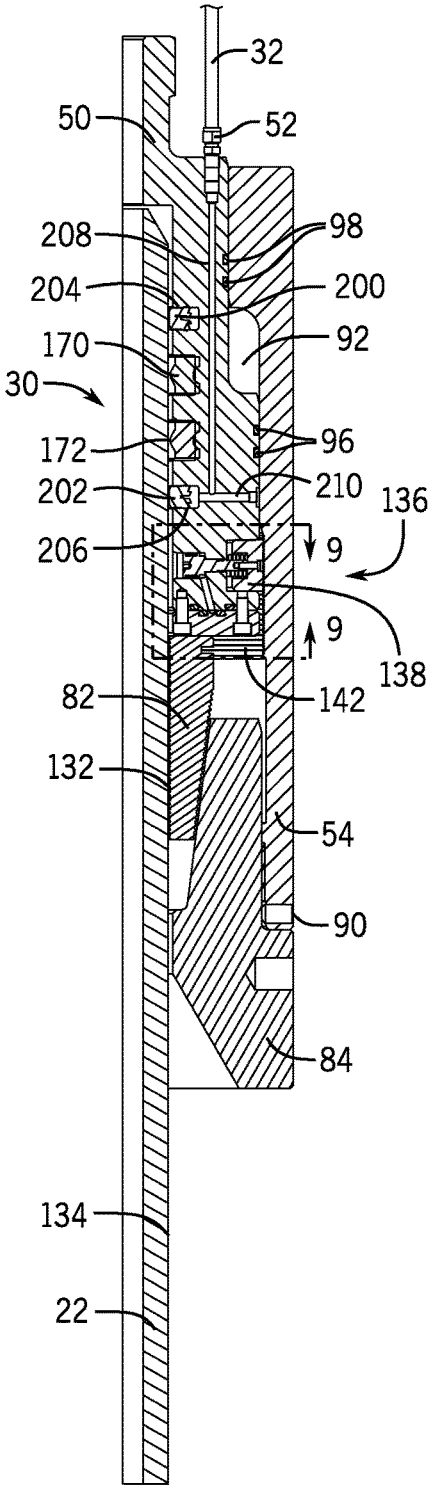
FIG. 7 is a cross-sectional view along line 7-7 of FIG. 5 of an embodiment of a hydraulic connector system in a locked position.

FIG. 7 is a cross-sectional view along line 7-7 of FIG. 5 of an embodiment of a hydraulic connector 18 in a locked position. In some embodiments, the hydraulic connector 18 may include seals 200 and 202 (e.g., annular seals) that rest within respective annular grooves 204 and 206 in the hydraulic block 50. After lowering the hydraulic connector 18, the seals 200 and 202 may be actuated to form a seal with the casing 22. For example, once the hydraulic connector 18 couples to the casing 22, the hydraulic connector 18 may actuate seal 202 using pressurized fluid that flows through an axial passage 208 that fluidly couples to a radial passage 210. In operation, fluid flows through the axial passage 208 and into the radial passage 210. The radial passage 210 then directs the fluid toward the seal 202. As pressure builds in the axial and radial passages 208, 210, the fluid drives and actuates the seal 202 forming a seal with the casing 22. In some embodiments, the radial passage 210 may extend completely through the hydraulic block 50. Accordingly, some embodiments may include a plug 208 that blocks fluid flow from exiting through the radial passage 210 and contacting the sleeve 54.

Figure 8:
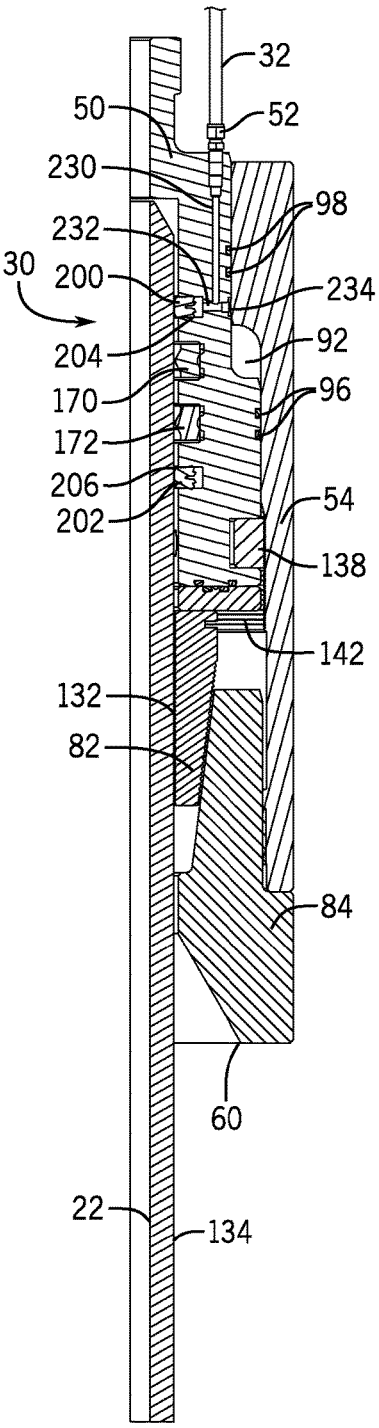
FIG. 8 is a cross-sectional view along line 8-8 of FIG. 5 of an embodiment of a hydraulic connector system in a locked position.

FIG. 8 is a cross-sectional view along line 8-8 of FIG. 5 of an embodiment of a hydraulic connector 18 in a locked position. As explained above, the hydraulic connector 18 may include seals 200 and 202 that are actuated to form a seal with the casing 22. For example, once the hydraulic connector 18 couples to the casing 22, the hydraulic connector 18 may actuate the seal 200 using pressurized fluid that flows through an axial passage 230 that fluidly couples to a radial passage 232. In operation, fluid flows through the axial passage 230 and into the radial passage 232, which then directs the fluid toward the seal 200. As pressure builds in the axial and radial passages 230, 232 the fluid drives and actuates the seal 200 forming a seal with the casing 22. In some embodiments, radial passage 232 may extend completely through the hydraulic block 50. Accordingly, some embodiments may include a plug 234 that blocks fluid flow from exiting through the radial passage 210 and contacting the sleeve 54.

Figure 9:
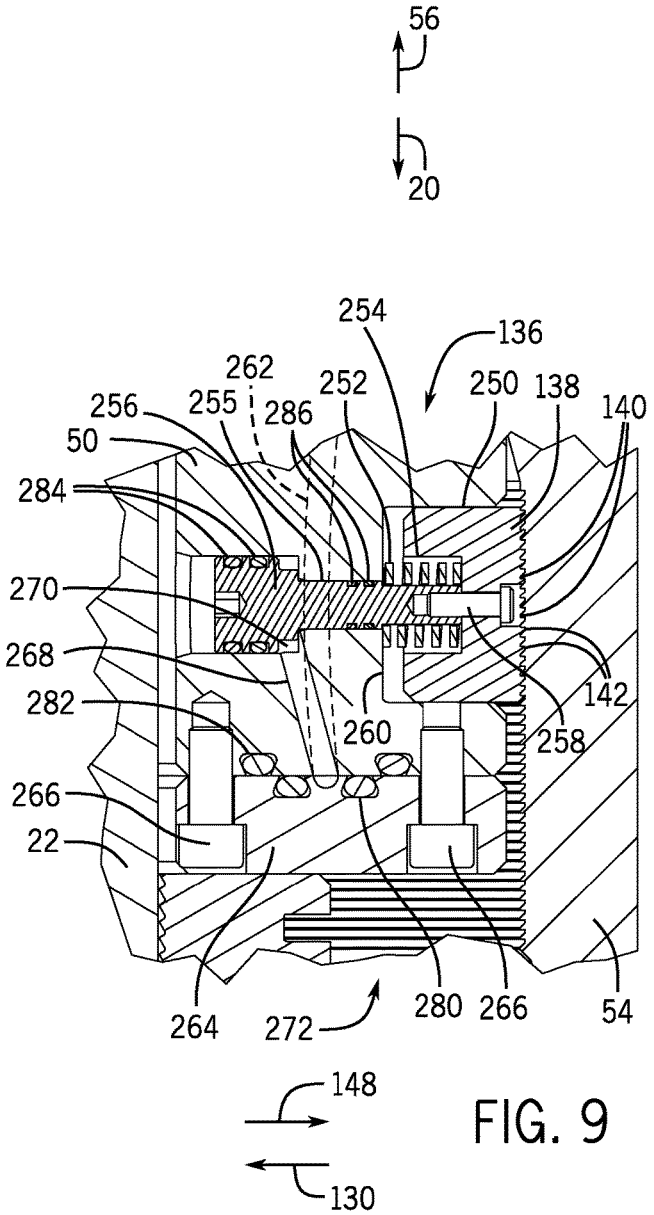
FIG. 9 is a cross-sectional view within line 9-9 of FIG. 7 of an embodiment of a lock ring system in a locked position.

FIG. 9 is a cross-sectional view within line 9-9 of FIG. 7 of an embodiment of a lock ring system 136 in a locked position. In order to selectively enable and block the sleeve 54 from sliding in axial direction 20, the hydraulic connector 18 includes the lock ring system 136. As explained above, the lock ring system 136 includes a lock ring 138 (e.g., segmented ring or c-ring) with protrusions 140 (e.g., teeth) that engage corresponding grooves 142 (e.g., annular grooves) on an interior surface 144 of the sleeve 54. In some embodiments, the lock ring system 136 may include a plurality of segments that engage sleeve 54. In operation, the protrusions 140 and grooves 142 block axial movement of the sleeve 54 in axial direction 20. In some embodiments, the protrusions 140 may be angled upward toward axial direction 56 and the grooves 142 may be angled downward toward axial direction 20. In this configuration, the protrusions 140 and grooves 142 enable the sleeve 54 to move axially in direction 56 during actuation of the locking system 28 while still blocking axial movement of the sleeve 54 in axial direction 20.

As illustrated, the lock ring 138 rests within a groove 250 (e.g., annular groove) and is biased with a spring 252 in radial direction 148, so that the protrusions 140 engage the recesses 142 on the sleeve 54. The spring 252, in turn rests within a counter bore 254 of the lock ring 138 and surrounds a rod 255 of a piston 256. The piston 256 (e.g., retraction piston) couples to the lock ring 138 with a connector 258 (e.g., threaded fastener, bolt, screw, latch, hook, weld, braze, etc.) enabling the piston 256 to retract the lock ring 138 in radial direction 130. As illustrated, the spring 252 contacts an interior surface 260 of the groove 250 and biases the lock ring 138 in radial direction 148 enabling the lock ring 138 to couple to the sleeve 54 and block movement of the sleeve 54 in axial direction 20. In order to retract the lock ring 138, fluid is pumped through a fluid passage 262 in the hydraulic block 50. The fluid travels through the passage 262, where the fluid contacts a seal ring 264 (e.g., annular ring). The seal ring 264 couples to the hydraulic block 50 with one or more connectors 266 (e.g., threaded fastener, bolts, screws, latch, hook, weld, braze, etc.). The seal ring 264 redirects the fluid from the passage 262 into the fluid passage 268. As the fluid flows through the fluid passage 268, the fluid enters a piston chamber 270 driving the piston 256 in radial direction 130. The movement of the piston 256 in radial direction 130 enables the piston 256 to retract the lock ring 138 by compressing the spring 252 (i.e., fluid pressure over comes spring force of the spring 252). In order to maintain fluid pressure the lock ring system 136 may include multiple seals 272. For example, the seal ring 272 and hydraulic block 50 may include a respective seal 274 and 276 (e.g., annular seals) that block fluid flowing through passage 262 from escaping between the seal ring 272 and the hydraulic block 50. As illustrated, the seals 274, 276 rest within respective grooves 280 and 282 (e.g., annular grooves) of the seal ring 264 and hydraulic block 50. The piston 256 may also include one or more seals 284 and 286 that block fluid from escaping the piston chamber 270, enabling pressure buildup within the chamber 270 for actuation of the piston 256. Accordingly, the lock ring system 82 may move in radial directions 146 and 148 enabling the hydraulic connector 18 to connect and disconnect from the casing 22.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a mineral extraction system, comprising:

a tubular with a fluid passage;

a hydraulic connector system configured to couple to the tubular, wherein the hydraulic connector system comprises:

a hydraulic block configured to couple to one or more fluid lines;

a first lock system having a first lock;

a sleeve coupled to the hydraulic block, wherein the sleeve is configured to move axially with respect to the hydraulic block to drive the first lock of the first lock system to move radially to couple and uncouple the hydraulic connector system with the tubular; and a second lock system having a second lock, wherein the second lock is configured to move radially to couple and uncouple the sleeve with the hydraulic block, and the second lock is configured to couple the sleeve with the hydraulic block to block movement of the sleeve and the first lock after the first lock couples the hydraulic connector system with the tubular.

2. The system of claim 1, wherein the hydraulic block and sleeve form a fluid actuation chamber that fluidly couples to one of the fluid lines, and the fluid actuator chamber is configured to receive hydraulic fluid to drive the sleeve to move axially with respect to the hydraulic block.

3. The system of claim 1, wherein the first lock comprises one or more lock segments, and the second lock comprises a lock ring.

4. The system of claim 1, wherein the second lock system has the second lock coupled to a piston, wherein the piston is configured to move the second lock radially from a locked position to an unlocked position.

5. The system of claim 4, wherein the second lock system comprises a spring configured to move the second lock from the unlocked position to the locked position.

6. The system of claim 1, comprising an energizing ring coupled to the sleeve.

7. The system of claim 6, wherein the energizing ring is configured to drive the first lock radially inward as the energizing ring moves in a first axial direction.

8. The system of claim 7, wherein the first lock forms an angled interface with the energizing ring.

9. The system of claim 1, wherein the first lock is disposed axially between an energizing taper coupled to the sleeve and a fluid actuation chamber configured to receive hydraulic fluid to drive the sleeve to move axially with respect to the hydraulic block.

10. The system of claim 1, wherein the hydraulic connector system comprises one or more seals.

11. The system of claim 10, wherein the hydraulic block comprises a passage configured to receive a fluid that activates one or more of the seals.

12. The system of claim 1, wherein the hydraulic block comprises a ledge configured to land on the tubular.

13. A system, comprising:

a hydraulic connector system configured to couple to a tubular, wherein the hydraulic connector system comprises:

a hydraulic block configured to couple to a fluid line;

a first lock system having a first lock;

a sleeve coupled to the hydraulic block, wherein the sleeve is configured to move axially with respect to the hydraulic block to drive the first lock of the first lock system to move radially to couple and uncouple the hydraulic connector system with the tubular; and a second lock system having a second lock, wherein the second lock is configured to move radially to couple and uncouple the sleeve with the hydraulic block, and the second lock is configured to couple the sleeve with the hydraulic block to block movement of the sleeve and the first lock after the first lock couples the hydraulic connector system with the tubular.

14. The system of claim 13, wherein the hydraulic block comprises a passage configured to couple to the fluid line, and wherein the passage is configured to deliver a fluid to an actuation chamber to drive the sleeve in an axial direction.

15. The system of claim 14, comprising an energizing ring coupled to the sleeve, wherein the energizing ring is configured to drive the first lock radially inward as the energizing ring moves in the axial direction.

16. The system of claim 13, wherein the hydraulic block comprises a passage that couples to the fluid line, and wherein the passage is configured to deliver a fluid to actuate a seal.

17. The system of claim 13, wherein the hydraulic block comprises a passage that couples to the fluid line, and wherein the passage is configured to deliver a fluid to test a seal.

18. The system of claim 13, wherein the hydraulic block comprises a passage that couples to the fluid line, and wherein the passage is configured to deliver a fluid to unlock a lock ring system.

19. A method, comprising:

coupling a hydraulic connector system onto a tubular, wherein coupling the hydraulic connector system to the tubular comprises driving a sleeve axially relative to a hydraulic block to drive a first lock of a first lock system to move radially to couple with the tubular;

driving a second lock of a second lock system to move radially to couple the sleeve with the hydraulic block after coupling the hydraulic connector system onto the tubular via the first lock; and sealing the hydraulic connector system to the tubular, wherein sealing the hydraulic connector system to the tubular comprises actuating a seal with fluid that passes through the hydraulic block.

20. The method of claim 19, comprising uncoupling the hydraulic connector system from the tubular, wherein uncoupling the hydraulic connector system from the tubular comprises driving the second lock of the second lock system to move radially to uncouple the sleeve from the hydraulic block, and driving the sleeve axially relative to the hydraulic block to drive the first lock of the first lock system to move radially to uncouple from the tubular.

21. The system of claim 13, wherein the first lock is disposed axially between an energizing taper coupled to the sleeve and a fluid actuation chamber configured to receive hydraulic fluid to drive the sleeve to move axially with respect to the hydraulic block.

22. The system of claim 13, wherein the first lock comprises one or more lock segments, and the second lock comprises a lock ring.

23. The system of claim 13, wherein the second lock system has the second lock coupled to a piston, wherein the piston is configured to move the second lock radially from a locked position to an unlocked position.

24. The system of claim 23, wherein the second lock system comprises a spring configured to move the second lock from the unlocked position to the locked position.

25. A system, comprising:

a hydraulic connector system configured to couple to a tubular, wherein the hydraulic connector system comprises:

a hydraulic block configured to couple to a fluid line;

a first lock system having a first lock and a shear pin;

a sleeve coupled to the hydraulic block; and an energizing taper coupled to the sleeve, wherein the sleeve is configured to move axially with respect to the hydraulic block to cause shearing of the shear pin and move the energizing taper to drive movement of the first lock to move radially to couple and uncouple the hydraulic connector system with the tubular, and the first lock is disposed axially between the energizing taper and a fluid actuation chamber configured to receive hydraulic fluid to drive the sleeve to move axially with respect to the hydraulic block.

26. The system of claim 25, wherein the first lock comprises one or more lock segments, and the energizing taper is disposed on an energizing ring coupled to the sleeve.

27. The system of claim 25, wherein the first lock comprising a mating taper configured to engage the energizing taper.

28. The system of claim 25, wherein the shear pin is disposed axially between the fluid actuation chamber and the energizing taper.

29. The system of claim 25, wherein the shear pin is directly coupled to the first lock.

* * * * *